United States Patent [19]

Tenbrummeler

[11] 4,079,559

[45] Mar. 21, 1978

[54] HINGED BASE FOR LIGHTING POLE

[75] Inventor: Bert Tenbrummeler, Westminister, Calif.

[73] Assignee: Kim Lighting, Inc., City of Industry, Calif.

[21] Appl. No.: 737,079

[22] Filed: Nov. 1, 1976

[51] Int. Cl.[2] ..... E04H 12/22; E02D 5/22

[52] U.S. Cl. ..... 52/295; 52/296; 248/519; 248/534

[58] Field of Search ..... 52/296–299, 52/295, 301; 240/84, 156, 158, 519, 533, 534; 404/9

[56] References Cited

U.S. PATENT DOCUMENTS

| | | | |
|---|---|---|---|
| 1,496,466 | 6/1924 | Jackson | 16/171 |
| 2,342,477 | 2/1944 | Magnenat | 16/171 |
| 2,794,208 | 6/1957 | Scroggins | 16/171 |
| 2,797,840 | 7/1957 | Gibbs | 16/171 |
| 2,903,103 | 9/1959 | Pfaff | 404/9 |
| 3,311,333 | 3/1967 | Galloway | 52/295 |
| 3,471,874 | 10/1969 | Dixon | 16/149 |

*Primary Examiner*—James L. Ridgill, Jr.
*Attorney, Agent, or Firm*—Donald D. Mon

[57] ABSTRACT

A hinged base attachable to a foundation and providing hinge means whereby a lighting pole can be tilted, and readily installed, removed and replaced. The base includes a pair of hinge plates, one of which carries a hinge pin and the other of which carries a hinge clevis. The hinge clevis has a channel with a first and a second channel width. The hinge pin has a first and a second pin width. The second widths are larger than the first widths and the first and second pin widths are no larger than the respective first and second channel widths. The pole is attachable to one of the hinge plates. When the other hinge plate is attached to the foundation, the pole can be tilted, and attached or detached thereto by passing the pin through the clevis channel with the first widths aligned. The pole is then tilted upright, and the first widths are no longer aligned. The clevis and pin are thus engaged, and the pole is firmly held to the foundation.

16 Claims, 4 Drawing Figures

HINGED BASE FOR LIGHTING POLE

This invention relates to hinged bases for lighting poles.

Hinged bases for lighting poles are known, and find utility where the pole is advantageously tilted down for maintenance work on the lighting fixture itself. Hinged bases are known for example in the Guggemos U.S. Pat. Nos. 3,141,620 and 3,364,635. The known devices tend to be large and bulky and do not provide for ready installation and removal of the pole itself.

It is an object of this invention to provide a hinged base for a lighting pole wherein only one part of the hinge need be initially attached to the foundation and the pole can be attached to the other part of the hinge means, the hinge means being separable. It is another object of this invention to provide a hinged pole base which can readily be installed at various angular orientations around its vertical axis.

A hinged pole base according to this invention is intended to be installed to a foundation by being held to a plurality of upwardly projecting studs. It includes a first and a second hinge plate, each of which has an aperture to pass one of the studs. There is a face on each of the plates so disposed and arranged as to bear against a foundation adjacent to the respective studs. Fastener means is engageable to said studs to hold the faces against the foundation. A hinge clevis is carried by one of the hinge plates. The clevis has a pair of arms which form a channel between them. The channel has an axis and an open and a closed side. The channel has a first channel width adjacent to the open side thereof, and a second channel width adjacent to the closed side thereof. The second channel width is larger than the first channel width.

A hinge pin is carried by the other one of the hinge plates. This hinge pin has an axis, a first pin width, and a second pin width which is angularly spaced from the first pin width. The second pin width is greater than the first pin width, and the respective first and second pin widths are no greater than the respective first and second channel widths. With the first widths aligned, the pin can be placed in and passed through the part of the channel having the first channel width to the region having the second channel width, and it may then be rotated so the two second widths are unaligned, thereby preventing removal of the pin from the channel. The post is attachable to one of the hinge plates, the axis of the pin being horizontal when the said widths are unaligned.

According to a preferred but optional feature of the invention, the pin is rigidly fixed to the other one of said hinge plates so that it rotates when the pole is tilted.

According to a preferred but optional feature of the invention, one of the hinge plates carries pole attachment means by which the pole is attachable thereto.

The above and other features of this invention will be fully understood from the following detailed description and the accompanying drawings in which.

Figure 1:
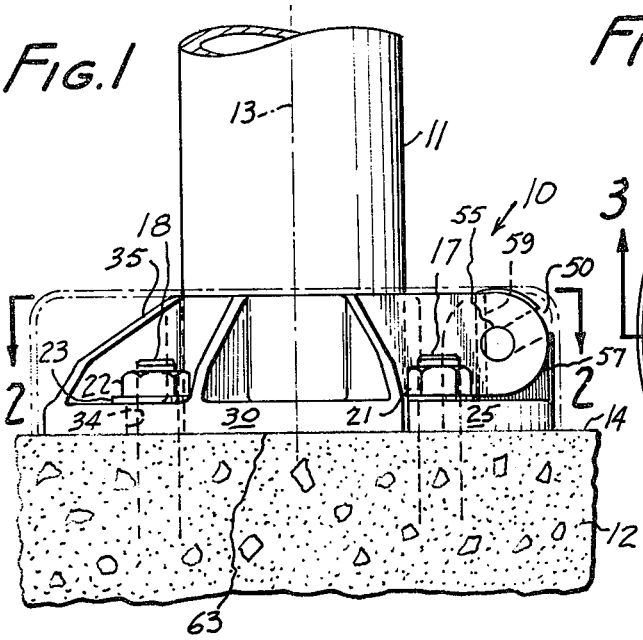
FIG. 1 is a side elevation, partly in cutaway cross-section, showing the presently preferred embodiment of the invention.

In FIG. 1 there is shown a hinged base 10 according to the invention. Its purpose is to support a lighting fixture pole 11 on a foundation 12 such as a poured concrete block. The pole may and usually will have its axis 13 vertically oriented. It is shown with a cylindrical shape. The shape of the pole itself is immaterial to this invention, and other cross-sections such as square, rectangular, cruciform, oval, or hexagonal, for example, can be used. Also, the pole need not be straight.

The foundation has a top surface 14 against which the hinged base is brought to bear. It also includes a plurality of upwardly projecting studs 15, 16, 17, 18. There may be any desired number of studs, and they are preferably equally angularly spaced around the central axis 13. This enables the base to be mounted at different angular positions around the axis so there is a selectability of directions (in this example, four) in which the pole can be tilted depending upon which of the holes yet to be described is passed over which of the studs. Fasteners 19, 20, 21, 22, in this example common threaded nuts, are threaded onto the studs to hold the hinged base to the foundation. Washers 23 are placed beneath the fasteners.

The hinged base includes a first hinge plate 25 that forms a segment of a circular pattern. Conveniently this segment may be approximately 135° of the total periphery. Other included angles could be selected instead, such as 180°. However, 135° is a convenient arrangement, and makes room for the ribbed arrangement shown in the figures.

A second hinge plate 30 forms the remainder of the periphery.

Figure 2:
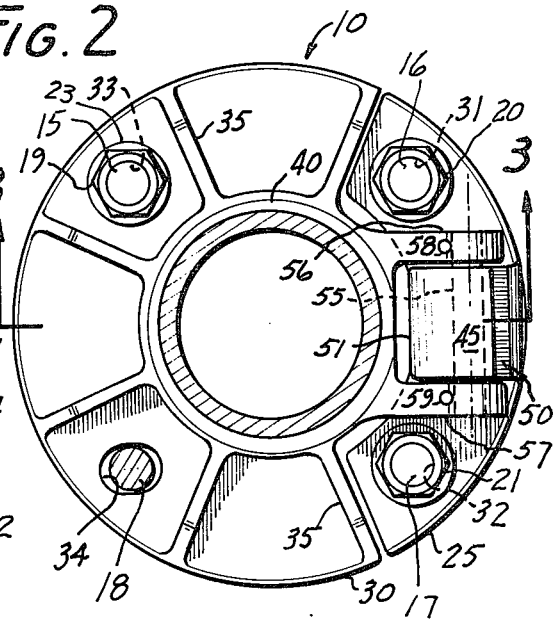
FIG. 2 is a cross-section taken at line 2—2 in FIG. 1.

First hinge plate 25 has a pair of holes 31, 32 and a second hinge plate has holes 33, 34. Holes 31 and 32 are round and just give clearance for the studs over which they are passed. Holes 33 and 34 are elongated, as best shown in FIG. 2. This is for the purpose of providing clearance to pass the studs when the hinge plate is tilted downward toward the foundation. The amount of necessary hole elogation is a function of the length and diameter of the stud. The narrowest width of holes 33 and 34 is such that the respective fasteners will overlay part of the hinge plate so as to hold the hinge plate in place. Washers will be supplied, but can be eliminated in some cases, where the dimensions and loads permit.

A plurality of stiffening ribs 35 is formed on the second hinge plate. The second plate carries pole attachment means 40 in the form of an axially extending tube to receive the pole as shown in the figures. A weldment 41 may be used to join the pole to the second hinge plate if desired. It can be located inside means 40 so it is invisible when the pole is installed. Any other suitable attachment means may be used instead. The second hinge plate includes a shoulder 42 inside the attachment means against which the end of the pole can be brought to bear and to which it can be welded. Shoulder 42 is for ease in assembly, and can be eliminated. Also, tube 40 could be eliminated, and the pole welded directly to the hinge plate. The weld would then constitute "pole attachment means". The stiffening ribs add strength and side support to the pole attachment means.

The outside cross-section of the pole adjacent to the base is preferably uniform axially, and the opening in the collar can (but need not) match its surface so as to receive and embrace it. This provides a strong and reliable joinder. Obviously, such a fit is not necessary to the enjoyment of this invention.

Figure 3:
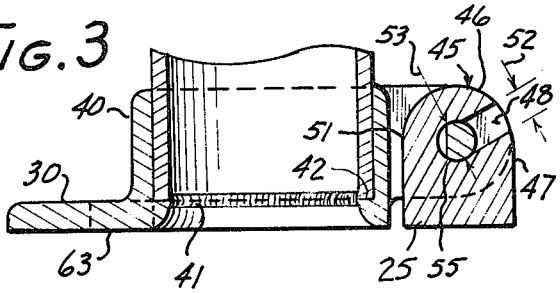
FIG. 3 is a cross-section taken at line 3—3 of FIG. 2.

One of the hinge plates, in this arrangement the first hinge plate 25, carries a hinge clevis 45. The clevis rises from the hinge plate and includes a pair of arms 46, 47 that are spaced apart to form a channel 48 between them. The channel has an axis 49 (FIG. 2). The channel has an open side 50 and a closed side 51. It has a first channel width 52 (FIG. 3) adjacent to the open side, and a second channel width 53 adjacent to the closed side. The second channel width is larger than the first channel width.

A hinge pin 55 is carried by plate 30, between two flanges 56, 57. It is held in place by a pair of drive pins 58, 59 so that it does not rotate relative to hinge plate 30. It will be recognized however, that independent rotation of the hinge pin relative to the hinge plate might be provided for. However, in the preferred embodimet of the invention, the hinge plate will rotate only with the second hinge plate relative to the first hinge plate.

Figure 4:
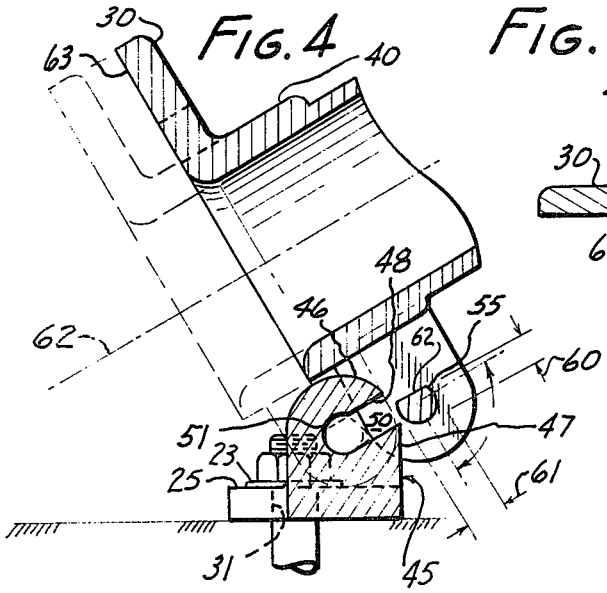
FIG. 4 shows the device of FIG. 1 tilted and removed.

The hinge pin has an axis coaxial with axis 49 when the divice is assembled, a first pin width 60 and a second pin width 61 (FIG. 4). The second pin width is greater than the first pin width. This is created by forming a flat 62 on the otherwise round pin. The respective first and second pin widths are no greater than the first and second channel widths. Therefore, with the first widths aligned as in FIG. 4, the pin can be placed in and passed through the part of the channel having the first channel width to the region having the second channel width. The pin may then be rotated so that the two second widths are unaligned as in FIG. 3, thereby preventing the removal of the pin from the channel and therefore also preventing separation of the two hinge plates from one another.

In the preferred embodiment of the invention, change of alignment of widths is caused by tilting the pole, the pin being rigidly attached relative to the pole. It is, however, equally possible to loosen the pin and rotate it independently so that the pole can be installed or removed in other angular orientations relative to the pole than the single one shown. However, the rigid attachment of the pin to the second hinge plate provides the advantage that there is a unique angular position at which the pole can be installed and removed instead of many, and this provides greater assurance of stability during tilting operation.

The installation and use of this hinged pole base should be evident from the foregoing. The first hinge plate is attached to any selected adjacent pair of studs and tightened down. Then the hinge pole is tilted to the angle shown in FIG. 4 so that the first widths are aligned. This is sometimes called an "oblique angle", and means that the pole is tilted so it is neither vertical nor horizontal. The pole is then moved along the angular axis 65 to the dashed line position in FIG. 4. Thereafter the pole is tilted to the FIG. 3 position. This locks the pin in the larger portion of the channel. At the same time, the holes in the second hinge plate will have passed over the ends of the studs, and the under face 63 of the second hinge plate will have been brought against the top surface of the foundation. The fasteners will then be put onto the studs are tightened down against the second plate, and the installation will be complete.

It will be observed that the only initial preparation for this installation is that of making the foundation and of attaching the first hinge plate to the foundation. Thereafter it is merely necessary to bring the pole in at the proper angle to align the pin or to have the pin aligned at the proper angle in any event, then to move the second hinge plate into flush contiguity with the foundation, either simultaneously rotating the pin to its and the pole, or rotating the pin independently of the pole (depending on whether the pin is rotatable independently of the plate), and then applying the fasteners to the remaining studs. The base can be covered by a ring-shaped base cover to conceal the mechanism, and will then have the same appearance as any conventional pole base.

It is evident that the clevis can be carried by plate 30 instead of by plate 25, and the pin by plate 25 instead of by plate 30.

The foundation as defined includes the studs, the concrete block, or whatever else supports the studs, and also includes an upwardly facing abutment portion, which in the preferred arrangement is the top surface of the concrete block. The studs are adjacent to this portion. The downwardly facing faces on the hinge plates are brought to bear against the upwardly facing portions by the attachment means. In the preferred arrangement, the faces make a full area contact with the top of the concrete block, but it is clear that only an abutment is necessary, and that it can be less than full area, and spaced from, or directly adjacent to, the studs. The studs, because they form part of the foundation, could even carry such a portion.

The invention is not to be limited by the embodiments shown in the drawings and described in the description which are given by way of example and not of limitation, but only inaccordace with the scope of the appended claims.

I claim:

1. A hinged base for mounting a lighting pole to a foundation, said foundation including a plurality of upwardly projecting studs and an upwardly facing abutment portion, said hinged base comprising:

a first and a second hinge plate, each having an aperture to pass a respective one of said studs, and a face on each of said plates so disposed and arranged as to face downwardly to bear against said upwardly facing abutment portion of said foundation;

fastener means engageable to said studs and adapted to bear against the respective hinge plate to press the said face in abutment against said upwardly facing portion of said foundation;

a hinge clevis carried by one of said hinge plates, said clevis having a pair of arms which form a channel between them, said channel having an axis, and an open and a closed side, said channel having a first channel width adjacent to the open side thereof, and a second channel width adjacent to the closed side, the second channel width being larger than the first channel width; a hinge pin carried by the other one of said hinge plates, said hinge pin having an axis, a first pin width, and a second pin width angularly spaced from the first pin width, said second pin width being greater than the first pin width, the respective first and second pin widths being no greater than the respective first and second channel widths, whereby with the first widths aligned, the pin can be placed in and passed through the part of the channel having the first channel width to the region having the second channel width, and may then be rotated so the two second widths are unaligned, thereby preventing removal of the pin from the channel, said post being attachable to one of said hinge plates, the axis of the pin being horizontal when the said widths are unaligned.

2. A hinged base according to claim 1 in which the dimension of first width associated with the hinge plate to which the post is not to be attached is, when the said hinge plate is arranged with its face against the upwardly facing portion of the foundation, disposed at an oblique angle relative to the foundation.

3. A hinged base according to claim 1 in which the hinge pin is non-rotatably attached to its respective hinge plate.

4. A hinged base according to claim 1 in which the hinge pin is rotatably attached to its respective hinge plate.

5. A hinged base according to claim 1 in which said first hinge plate is formed as a segment and carries said hinge clevis, and in which said second hinge plate is also formed as a segment and carries said hinge pin, the dimension of first channel width lying at an oblique angle to the face of the said first hinge plate.

6. A hinged base according to claim 5 in which both of said hinge plates have a plurality of said apertures, the aperture in the hinge plate carrying the pole being elongated to pass respective studs while pivoting toward contiguity with said foundation.

7. A hinged base according to claim 1 in which pole attachment means is carried by one of said hinge plates.

8. A hinged base according to claim 7 in which said pole attachment means comprises a tubular collar.

9. In combination: a hinge according to claim 1; and a a pole attached to one of said hinge plates.

10. A combination according to claim 9 in which the hinge pin is non-rotatably attached to its respective hinge plate.

11. A combination according to claim 9 in which the hinge pin is rotatably attached to its respective hinge plate.

12. A combination according to claim 9 in which the dimension of first width associated with the hinge plate to which the post is not to be attached is, when the said hinge plate is arranged with its face against the upwardly facing portion of the foundation, disposed at an oblique angle relative to the foundation.

13. A combination according to claim 9 in which said first hinge plate is formed as a segment and carries said hinge clevis, and in which said second hinge plate is also formed as a segment and carries said hinge pin, the dimension of first channel width lying at an oblique angle to the face of the said first hinge plate.

14. A combination according to claim 13 in which both of said hinge plates have a plurality of said apertures, the aperture in the hinge plate carrying the pole being elongated to pass respective studs while pivoting toward contiguity with said foundation.

15. A combination according to claim 9 in which one of said hinge plates carries pole attachment means, said pole being attached thereto by said means.

16. A combination according to claim 15 in which said pole adjacent to said base has a uniform outside cross-section, and said pole attachment means is a collar having an opening matching the outside cross-section in which the pole is fitted.

* * * * *